US006463598B2

(12) United States Patent
David et al.

(10) Patent No.: US 6,463,598 B2
(45) Date of Patent: Oct. 15, 2002

(54) ACCESSORY FOR DISTRIBUTING FRESH WATER FROM A FAUCET TO BATHERS

(76) Inventors: Victor B. David, 6319 Maplebrook La., Flint, MI (US) 48507; Thomas Flowers, 1069 E. York, Flint, MI (US) 48505

( * ) Notice: Subject to any disclaimer, the term of this patent is extended or adjusted under 35 U.S.C. 154(b) by 0 days.

(21) Appl. No.: 10/039,958

(22) Filed: Oct. 24, 2001

(65) Prior Publication Data

US 2002/0066139 A1 Jun. 6, 2002

Related U.S. Application Data

(63) Continuation-in-part of application No. 09/676,646, filed on Sep. 29, 2000, now abandoned.
(60) Provisional application No. 60/157,138, filed on Sep. 30, 1999.

(51) Int. Cl.[7] ..... A47K 3/00
(52) U.S. Cl. ..... 4/591; 4/541.3
(58) Field of Search ..... 4/541.1, 541.3, 4/591, 569, 545; 248/363

(56) References Cited

U.S. PATENT DOCUMENTS 776,209 A * 11/1904 Wallen ..... 4/569
1,438,373 A * 12/1922 Gould
2,100,186 A * 11/1937 Hagopian
3,078,474 A * 2/1963 Chaitlen
3,465,369 A * 9/1969 Ostrowsky ..... 4/568
3,976,274 A * 8/1976 Langguth
4,010,498 A * 3/1977 Jablonski ..... 4/569
4,225,984 A * 10/1980 Lindsey
5,050,591 A * 9/1991 Sandrin
5,318,262 A * 6/1994 Adams
5,928,171 A * 7/1999 Larsen ..... 4/546
5,940,904 A * 8/1999 Lutz ..... 4/541.3
6,108,829 A * 8/2000 Wadsworth ..... 4/541.3

FOREIGN PATENT DOCUMENTS

FR 2 678 826 A1 * 1/1993 ..... 4/541.3

* cited by examiner

*Primary Examiner*—Charles R. Eloshway

(57) ABSTRACT

An accessory for a bathtub has a tubular conduit that is placed around the rim of a bathtub and connected to the faucet. The conduit has outlets at locations along its length. When the faucet is turned on, fresh water is conveyed through the conduit to the outlets where the water leaves the conduit and enters the tub by washing down the sides of the tub in the manner of a waterfall. The conduit is non-metallic and supported by plastic or rubber elements. It can be conveniently installed and removed.

15 Claims, 11 Drawing Sheets

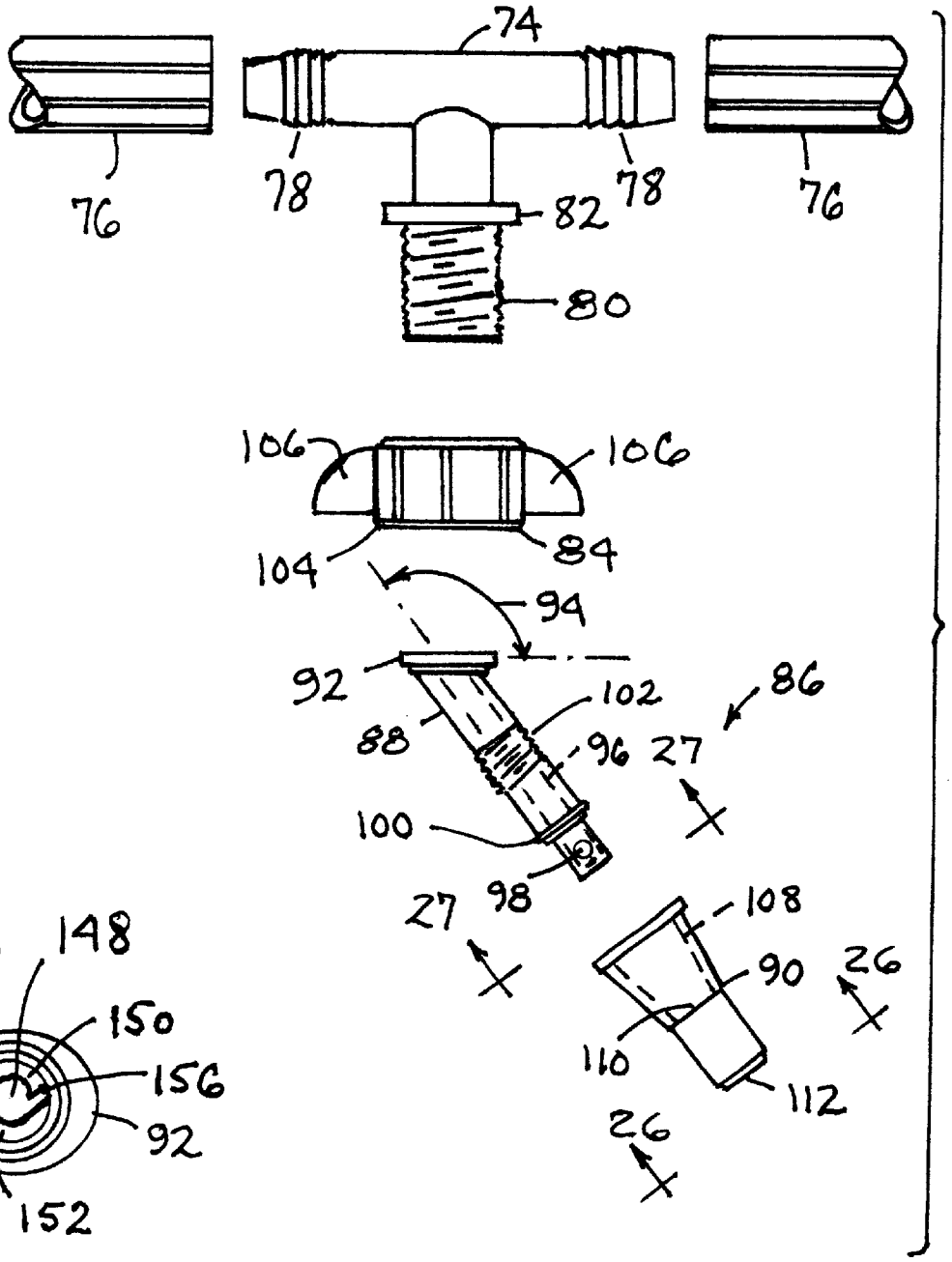
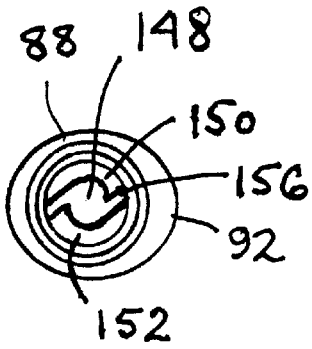
FIG. 27
FIG. 25
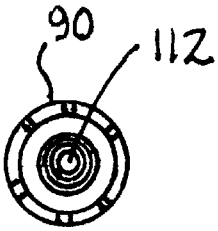
FIG. 26

ACCESSORY FOR DISTRIBUTING FRESH WATER FROM A FAUCET TO BATHERS

REFERENCE TO RELATED APPLICATIONS AND PRIORITY CLAIM

This application is a continuation-in-part, and claims the priority, of non-provisional patent application Ser. No. 09/676,646, filed Sep. 29, 2000, now abandoned, which is derived from Provisional Application Ser. No. 60/157,138 filed Sep. 30, 1999 whose priority is also claimed.

FIELD OF THE INVENTION

This invention relates to an accessory that attaches to a faucet and delivers water to a bather or bathers in a bath area. Such a bath area may be any sort of vessel like a bathtub, an indoor or outdoor swimming pool, or an outdoor area.

BACKGROUND OF THE INVENTION

Various accessories that attach to a bathtub faucet and serve to introduce water into a bathtub are known. Some are hand-held; others are mounted on the tub. Examples of such accessories appear in issued patents, many of which date back some one hundred years. In those times, bathtubs were essentially free-standing. Accessories could be made of rigid pipes, and installed on a bathtub without concern for clearances to adjacent walls. Such installations appear to have been intended to be essentially permanent. The accessories were attached directly onto bathtub rims by metal clamps and the like, or they were disposed adjacent the bathtub.

The inventors believe that many of today's households would enjoy an accessory that could introduce water into a bathtub, if the accessory could be conveniently installed in and removed from a built-in bathtub, and if it avoided the use of rigid metal pipes.

SUMMARY OF THE INVENTION

The accessory of the present invention comprises a tubular conduit that is placed around the rim of a bathtub and connected to the faucet. The conduit has outlets at locations along its length. When the faucet is turned on, fresh water is conveyed through the conduit to the outlets where the water leaves the conduit and enters the tub by washing down the sides of the tub in the manner of a waterfall. The conduit is non-metallic and supported by plastic or rubber elements. It can be conveniently installed and removed.

An additional aspect of the invention relates to an accessory that is believed to be especially appealing to children and that can be used not only in a bathtub, but in various bath areas, both indoor and outdoor. A particular embodiment comprises the use of three-dimensional characters who may be familiar to children. Examples of such characters are various animals, especially marine animals like dolphins and fish, and various cartoon and storybook characters.

BRIEF DESCRIPTION OF THE DRAWINGS

FIG. 25 is an exploded view showing additional parts of the FIG. 22 embodiment.

FIG. 26 is a view in the direction of arrows 26—26 in FIG. 25.

FIG. 27 is a view in the direction of arrows 27—27 in FIG. 25.

DESCRIPTION OF THE PREFERRED EMBODIMENT

Figure 1:
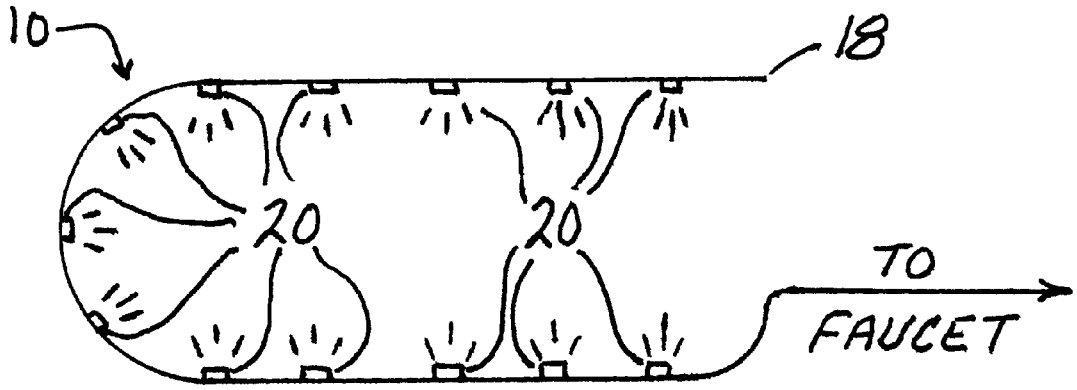
FIG. 1 shows a first basic configuration for the accessory of the present invention.
Figure 2:
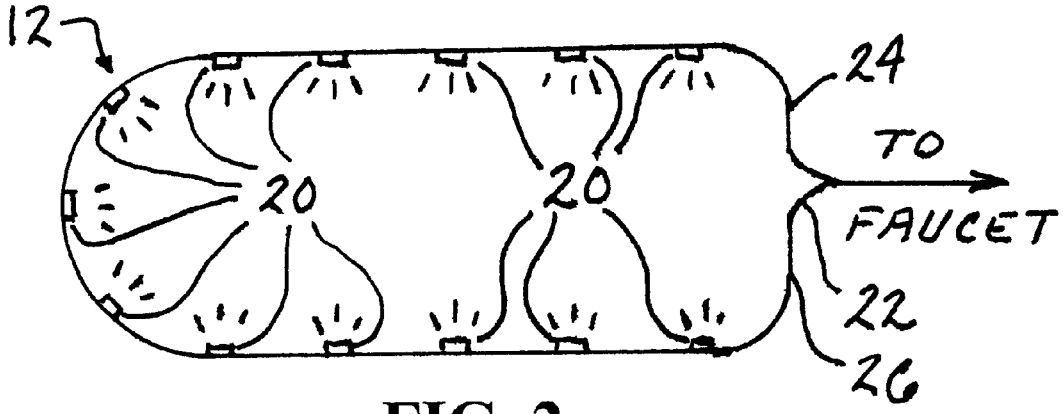
FIG. 2 shows a second basic configuration.
Figure 3:
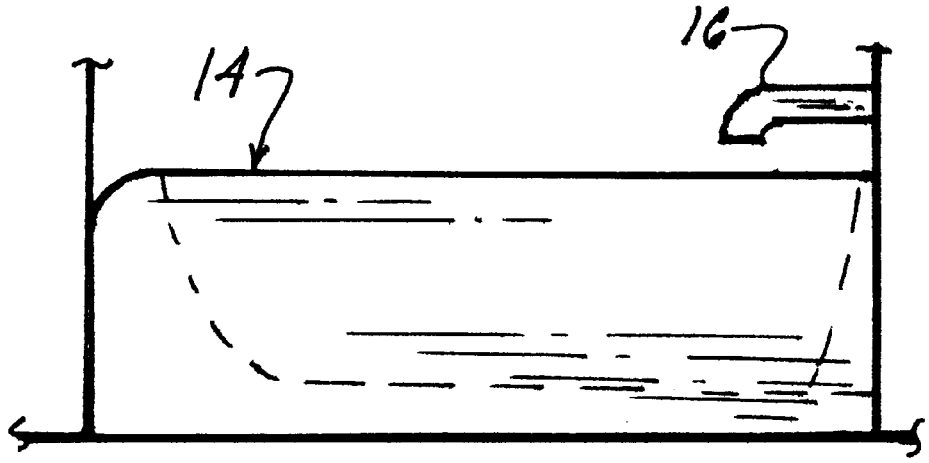
FIG. 3 shows the basic shape of a modern bathtub, including a faucet.

FIG. 1 shows a first basic configuration 10 for the accessory, and FIG. 2 shows a second basic configuration 12. FIG. 3 shows the basic shape of a modern bathtub 14, including a faucet 16. For convenience, the accessory configuration 10 of FIG. 1 may be referred to as a closed end length, and the accessory configuration 12 of FIG. 2 as a closed loop.

The closed end length configuration 10 of FIG. 1 comprises a tube that is open at a one end for connection to the tub faucet 16. The opposite end 18 of the tube is closed. The tube has a length sufficient to go around substantially the full perimeter of the tub rim. The tube has outlets 20 distributed along its length. When the faucet 16 is turned on, fresh water enters the open end of the tube and flows through the length of the tube. At each outlet 20, water flows out of the tube and washes down the inside of the tub 14. With the tub drain closed, this waterfall effect may be used to fill the tub with fresh water.

The closed loop configuration of FIG. 2 comprises an endless loop tube that goes around the entire perimeter of the tub rim. At the front it contains a tee 22 for connection to the tub faucet 16. The tube has outlets 20 distributed along its length. When the faucet is turned on, fresh water enters the tee and immediately branches to each side 24, 26. The water flows through the side branches, filling the entire tube. At each outlet 20, water flows out of the tube and washes down the side of the tub with the waterfall effect.

It is believed most desirable to make the water flow from each outlet generally the same as the flow at each of the other outlets so that there is general uniformity in washing water down the side of the tub along the entire tube perimeter. Therefore the outlets may be designed to take their distance from the faucet into account so that each outlet will flow about the same amount of water regardless of how distant it is from the faucet.

Figure 4:
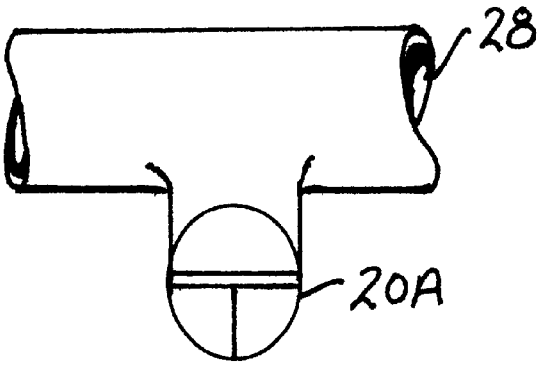
FIGS. 4, 5, 6, 7, and 8 show different forms of outlets.
Figure 5:
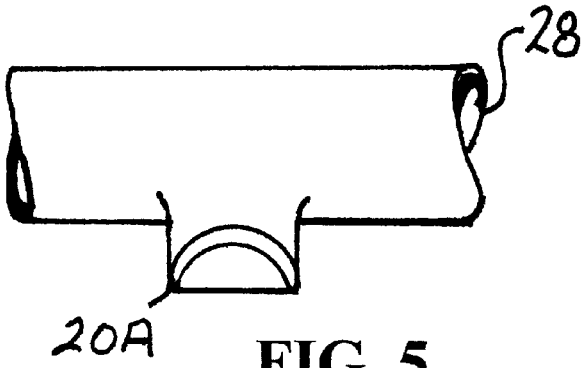

FIGS. 4, 5, 6, 7, and 8 show different forms of outlets. FIGS. 4 and 5 show an outlet 20A that has a spring-loaded valve for regulating the flow in response to the water pressure inside the tube 28. FIG. 4 shows the valve closed and FIG. 5 shows the valve open.

Figure 6:
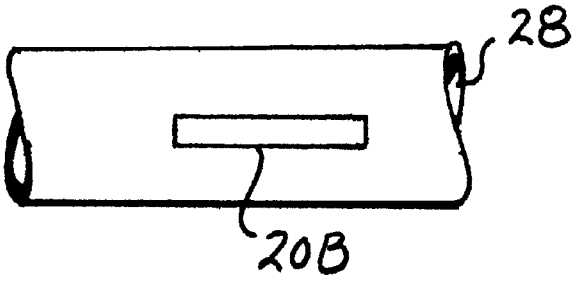
Figure 9:
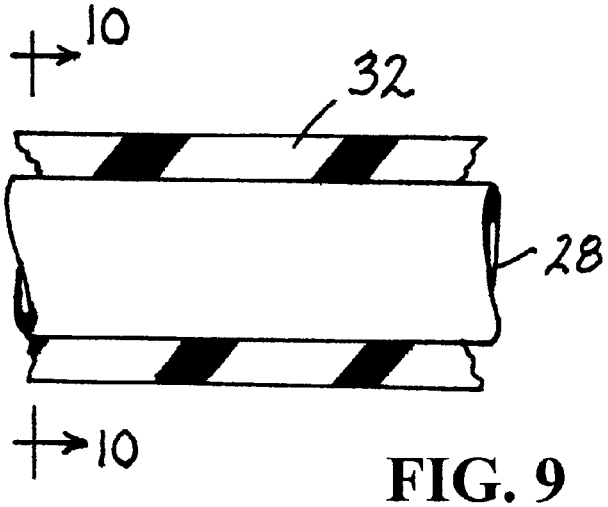
FIGS. 9, 10, 11, and 12 show a modified form.
Figure 10:
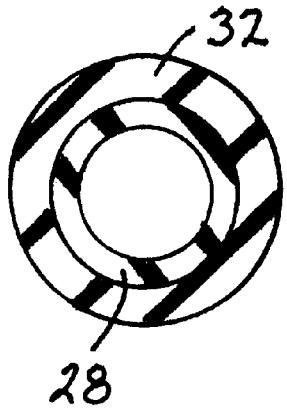

FIG. 6 shows an outlet 20B that is a rectangular shaped hole in the wall of the tube 28.

Figure 7:
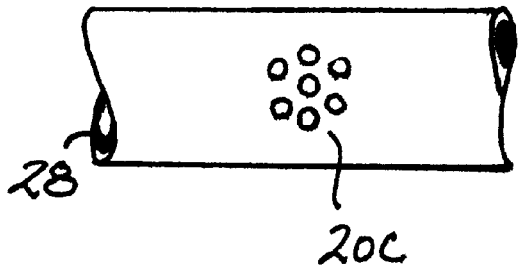

FIG. 7 shows an outlet 20C that is a cluster of small holes through the tube wall.

Figure 8:
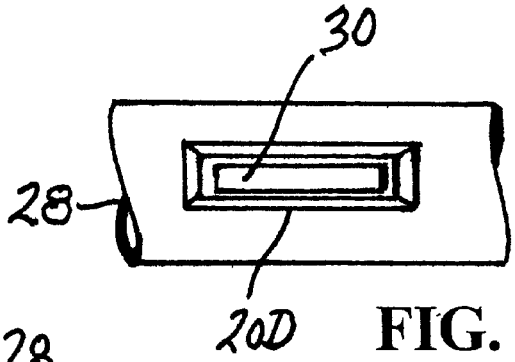

FIG. 8 shows an outlet 20D that is a separate element that is assembled to the tube 28. It has a rectangular shape and opening 30.

Figure 11:
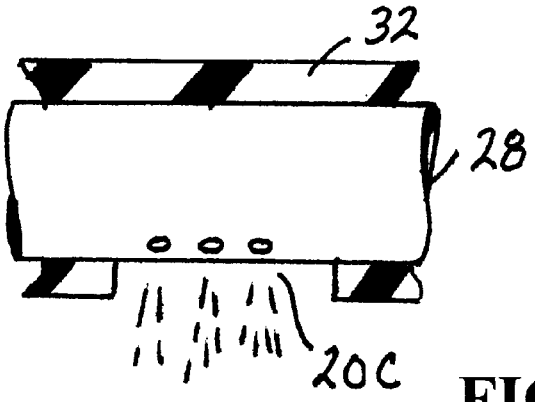
Figure 12:
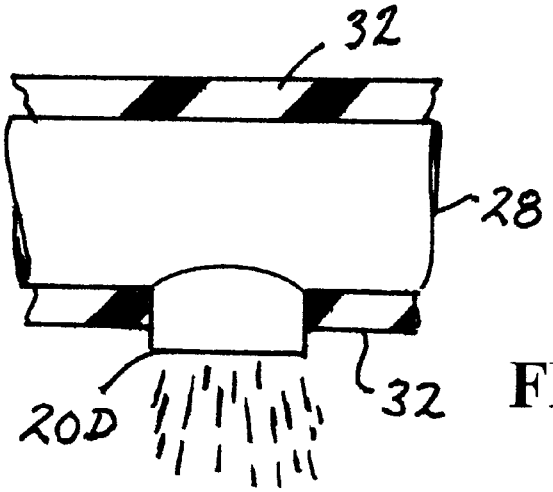
Figure 13:
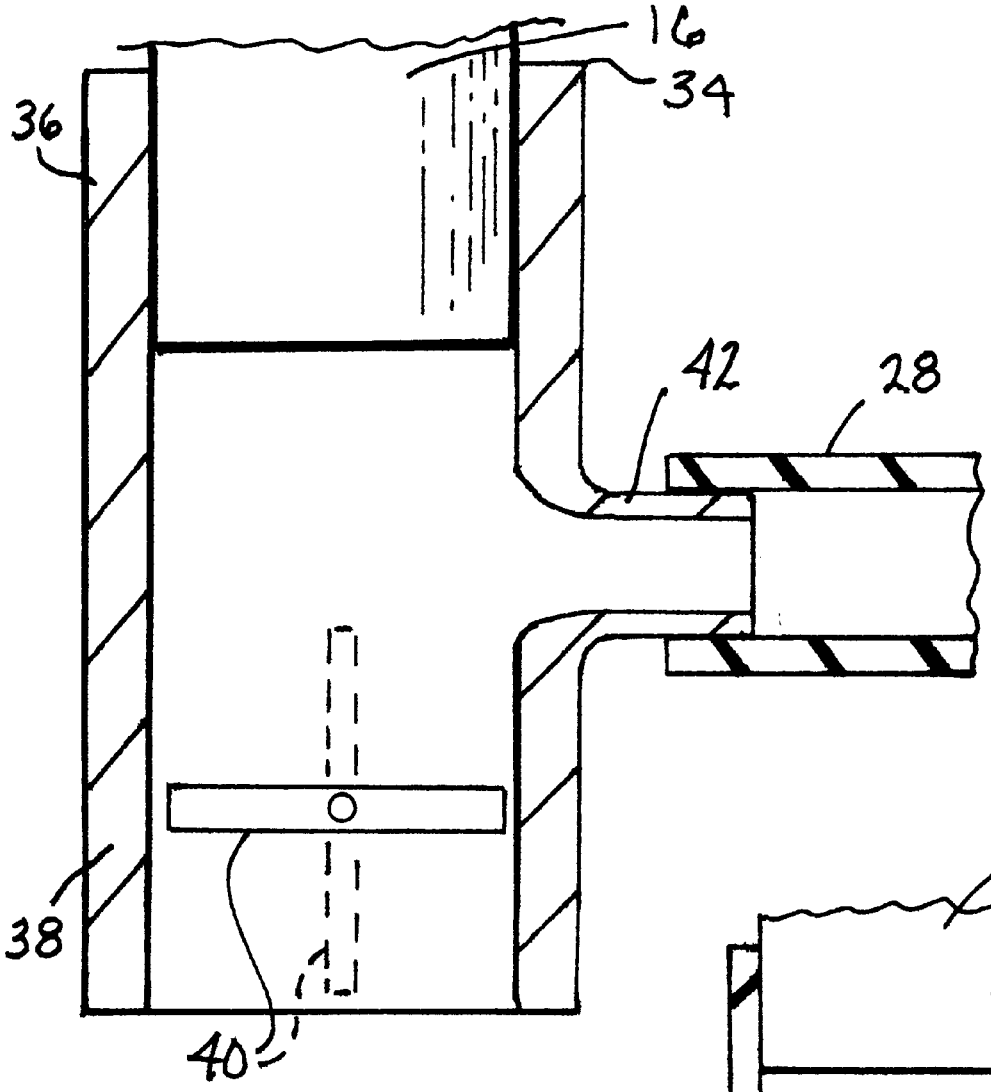
FIG. 13 shows another type of fitting for fitting onto a faucet.

For comfort and for decoration, tube 28 may be clad with a soft, spongy, decorative cover 32. This is shown in FIGS. 9, 10, 11, and 12. Wherever the tube 28 contains an outlet 20, the cover 32 is open so as not to obstruct the outlet. FIG. 11 shows an example where the outlet is like that in FIG. 7, and FIG. 12 shows an example where the outlet is like that in either FIG. 8 or FIGS. 4 and 5. While the accessory is useful in filling a tub with bath water via the waterfall effect mentioned earlier, a person may at certain times desire to use the faucet 16 directly for filling the tub. FIG. 13 shows an option that comprises a fitting 34 for fitting onto the faucet 16. The fitting comprises a tube one end of which 36 fits onto the faucet and the opposite end of which 38 contains a shut-off valve 40. The fitting has a tap 42 at the side, just above the shut-off valve. The end of a waterfall tube 28 having a configuration like configuration 10 or configuration 12 fits onto the tap 42. When the valve 40 is open, water from the faucet 16 flows straight down through the fitting, past valve 40, and directly into the tub. When the valve 40 is closed, water from the faucet 16 is diverted to the tap 42 where it enters the waterfall tube 28 and flows to the various outlets 20 where it enters the tub via the waterfall effect.

Figure 14:
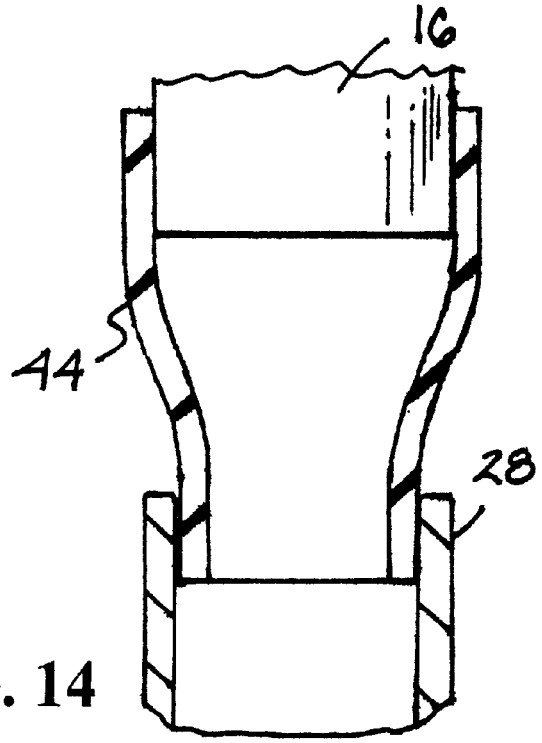
FIG. 14 shows still another type of fitting for fitting onto a faucet.

FIG. 14 shows an option that may make connection and disconnection of the waterfall tube easier and more convenient. The option is an adapter fitting 44 that fits onto the faucet 16, and is intended to remain there. One end of the adapter fitting 44 fits over the faucet 16. The other end provides for the waterfall tube 28 to be conveniently connected and disconnected.

Figure 15:
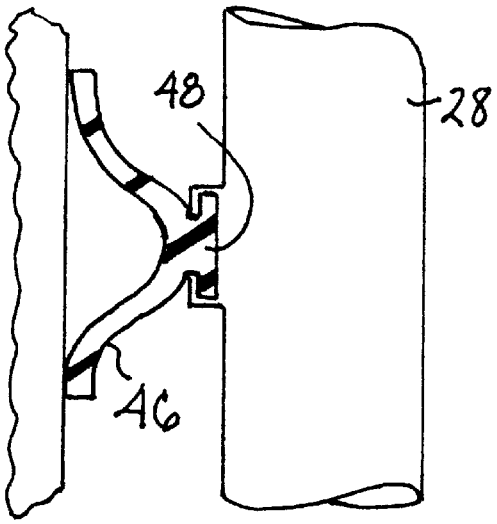
FIGS. 15, 16, 17, and 18 show examples of attachment devices.
Figure 16:
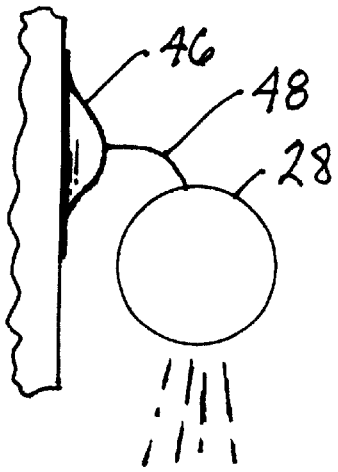
Figure 17:
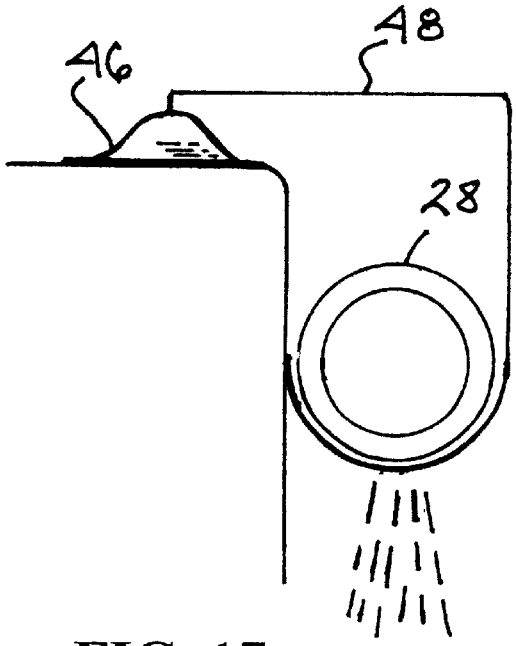

The waterfall tube can be easily installed on and removed from a bathtub by the use of attachment devices that include suction cups 46. FIGS. 15, 16, and 17 show examples of such attachment devices. Suction cups may adhere to either the side of the tub near the top, as in FIGS. 15 and 16, or to the top horizontal rim that runs around the tub, as in FIG. 17. The attachment devices may comprise rigid, or flexible, parts 48 between the suction cup and the waterfall tube 28. Covers of soft spongy material, like the cladding of the waterfall tube, may cover the rigid, or flexible parts. Like the cladding of the waterfall tube, the attachment device covers may provide decoration. Neoprene rubber with a decorative, or colored, coating, is suitable for the cladding. The particular thickness and degree of sponginess of the cladding may vary to some extent, and various designs and colors for the decorative coating are contemplated.

Figure 18:
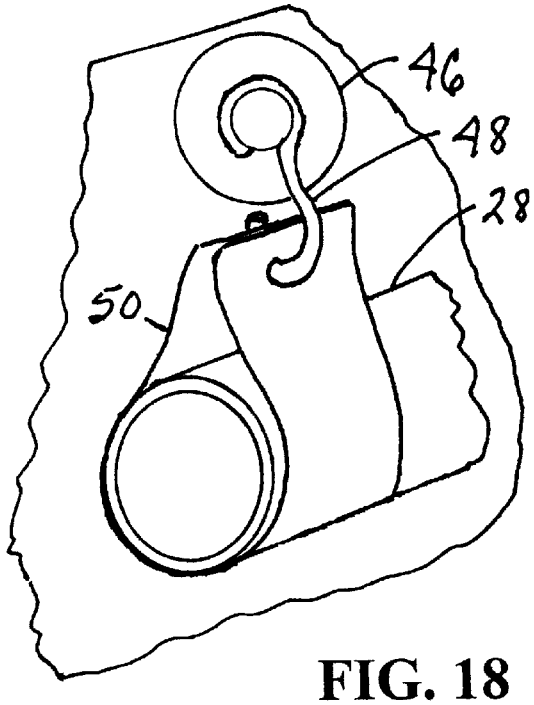

FIG. 18 shows another form of attachment device comprising a suction cup 46 that has a cylindrical post on its rear face. A wire 48 is attached to the post and has a hook that passes through ends of a plastic sling 50 that supports the waterfall tube. The sling may be integrated with the suction cup to eliminate the metal wire.

Figure 19:
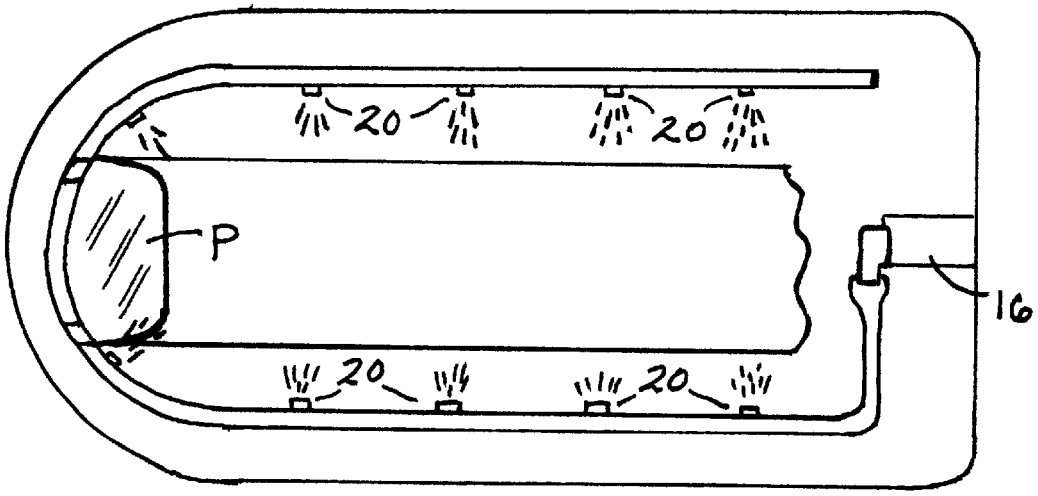
FIG. 19 shows the first basic configuration in a bathtub, including an additional feature.

At the rear of the tub the waterfall tube may include a pad P that forms a backrest for a person seated in the tub, as shown in FIG. 19. The pad may drape down from the waterfall tube and/or be integrated with the cladding. The pad may be neoprene and have a decorative or colored coating.

Figure 20:
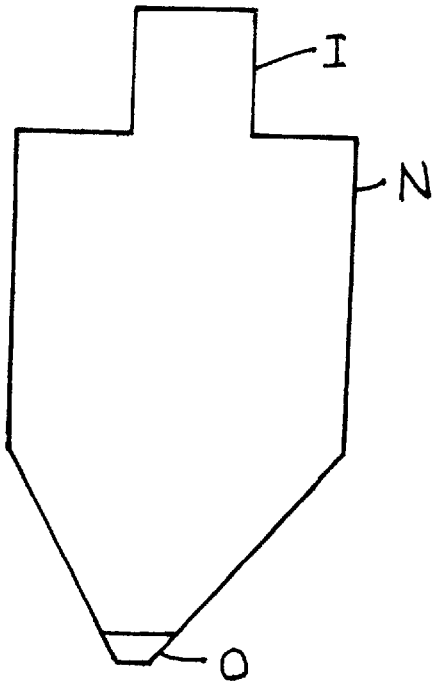
FIG. 20 shows another form of outlet.

FIG. 20 shows a nozzle N that can be used as an outlet. The nozzle comprises an inlet I that is connected to the tube, fitting to a hole in the tube in a sealed manner. The nozzle has an adjustment feature that provides for water to be emitted at the opposite end O as a stream, a spray, or a jet.

Figure 21:
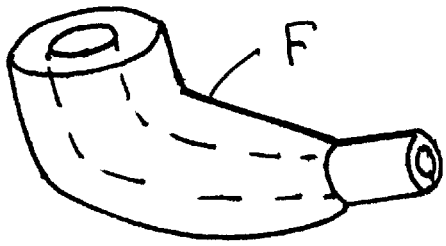
FIG. 21 shows another example of a faucet fitting.

A fitting F in FIG. 21 comprises stretchable rubber for fitting over the end of a faucet. The smaller opposite end connects into the tube. A valve, such as the one in FIG. 13, can be used to set the water pressure in the tube. Too high a water pressure from the faucet may tend to dislodge, or blow off, the fitting from the faucet if the tube is closed except for its outlets. By properly setting the valve to shunt some faucet water from the tube, blow off can be avoided. If a tube is connected directly to a faucet so that all the faucet water enters the tube, a valve may be mounted at the end of the tube instead, such as at 18 in FIG. 1.

The waterfall effect for filling a tub is especially useful if a tub is relatively cold to start with. By running warm water through the waterfall tube, the sides of the tub are heated as they are washed by the warm water. If a bather leans against the tub sides as the tub is being filled, he will feel the warmth of the water, not the cold that would be present if the tube were being filled in the usual way directly from the faucet without use of the waterfall tube. The soft spongy cladding of the tube and of the attachment devices provides comfort if a bather leans against them.

A further feature for the invention is to place a second configuration such as 10 or 12 at a lower level within the tub. When the level in the tub rises to a level covering that second configuration, water from the faucet can be introduced into it and emitted from its outlets to create a whirlpool effect in the tub. The two configurations may be fed from the faucet through a valve that allows flow through one, or the other, or both. The waterfall tube is also useful for rinsing the tub after use.

Figure 22:
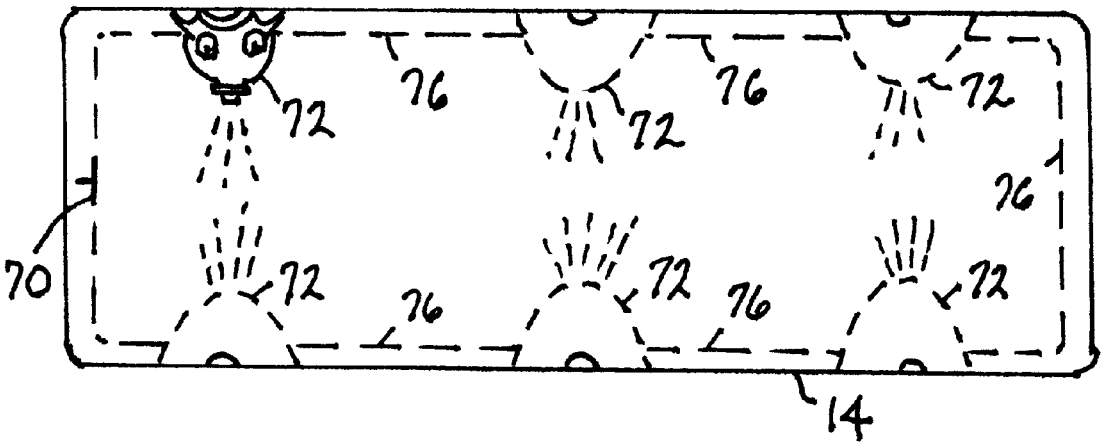
FIG. 22 is a view similar to FIG. 2 showing another embodiment.

The embodiment of FIG. 22 is a closed loop configuration like that of FIG. 2 comprising an endless loop tube that goes around the entire perimeter of the tub rim. At the front it contains a tee 70 for connection to the tub faucet. The tube has outlets 72 distributed along its length. When the faucet is turned on, fresh water enters the tee and immediately branches to each side. The water flows through the side branches, filling the entire tube. At each outlet 72, water exits the tube and is directed into the tub. Outlets 72 are different from outlets 20.

The endless loop tube than runs around the tub is constructed of a number of tee fittings and lengths of plastic or rubber conduit. The illustrated embodiment happens to have six outlets 72, each of which has a tee fitting 74, as shown in FIG. 25. Each outlet 72 is connected to the immediately adjacent ones by lengths of conduit 76. The two outlets 72 that are closest to the faucet connect via conduits 76 to opposite ends of tee 70.

In forming the endless closed loop around the tub, tee 70 and tee fittings 74 have opposite barbed ends 78 that allow the ends of conduits 76 to be pushed over them to create water-tight connections.

Between the opposite barbed ends, each tee fitting 74 has a branch that extends at a right angle to end in an external screw thread 80. A polygonal flange 82 is present at the proximal end of screw thread 80. A nut 84 serves to attach a nozzle assembly 86 to screw thread 80.

Nozzle assembly 86 comprises an inlet part 88 and an outlet part 90, both of which have generally cylindrical shapes. Inlet part 88 comprises a flat circular flange 92 at its proximal end. Flange 92 is arranged at other than a right angle to the longitudinal centerline of part 88, approximately 120° as marked by the double-headed arrow 94, part 88 has an internal passage 96 that runs along the centerline from flange 92 toward, but stopping short of, the opposite end of the part. A cross-bore 98 intersects passage 96 at that end of the part. Proximal to cross-bore 98, part 88 contains an O-ring seal 100 disposed in a circular groove in the exterior of the part. Proximal to seal 100, part 88 contains an external screw thread 102.

Part 88 is attached to tee fitting 74 by passing nut 84 over the distal end of part 88 and advancing the nut proximally along part 88 to the proximal end of the part. Nut 84 has an internal flange 104 at one end that radially overlaps flange 92. When the opposite end of the nut is threaded onto screw thread 80, the nut flange forces flange 92 against the end of tee fitting 74 at thread 80. Nut 84 has wings 106 that allow it to be tightened and untightened by hand.

With flange 92 having been sealed in this manner to the end of fitting 74 at screw thread 80, outlet part 90 can be fastened to inlet part 88. Part 90 is essentially tubular having an internal screw thread 108 for threading onto screw thread 102 of part 88. Distal to screw thread 108, part 90 has a circular cylindrical sealing surface that ends at an internal shoulder 110. From shoulder 110, part 90 extends to a small hole 112 centered at its distal end.

Part 90 is fastened to part 88 by advancing it proximally over the distal end of part 88 to engage screw thread 108 with screw thread 102. Part 90 is turned to tighten it onto part 88 via the threaded connection. Tightening is manifested by the sealing contact of O-ring seal 100 to the circular cylindrical sealing surface that is internal to part 90. Once that contact occurs, continued turning of part 90 on part 88 moves seal 100 along the internal circular cylindrical sealing surface of part 90 closer to shoulder 110.

Figure 23:
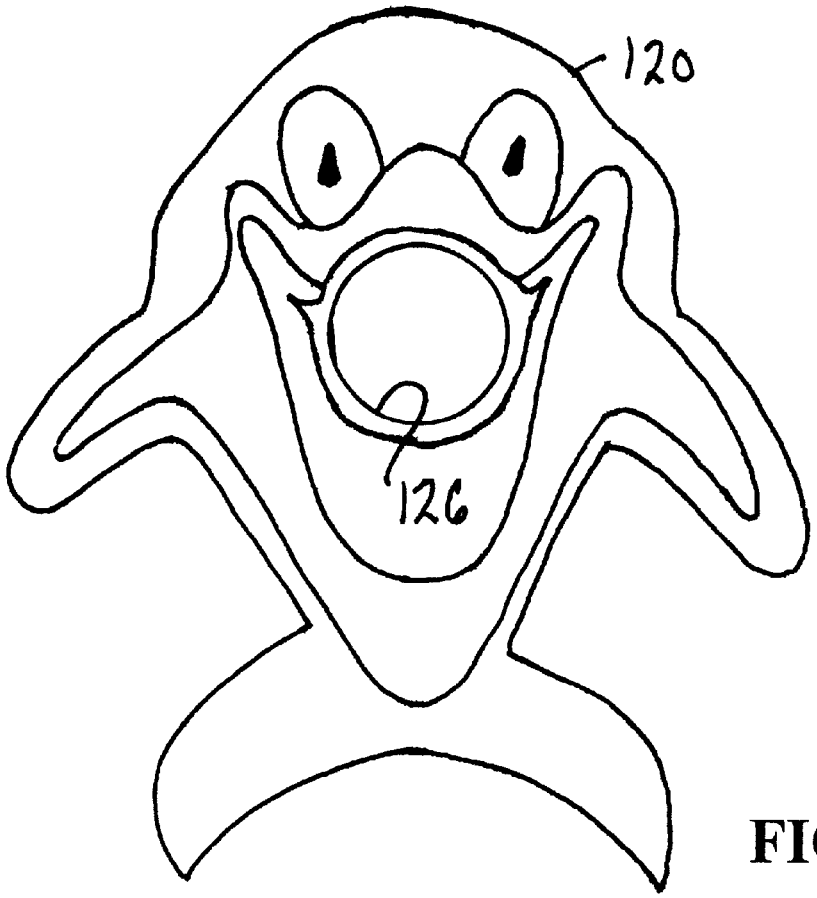
FIG. 23 is a front elevation view of one of the parts of the embodiment of FIG. 22.
Figure 24:
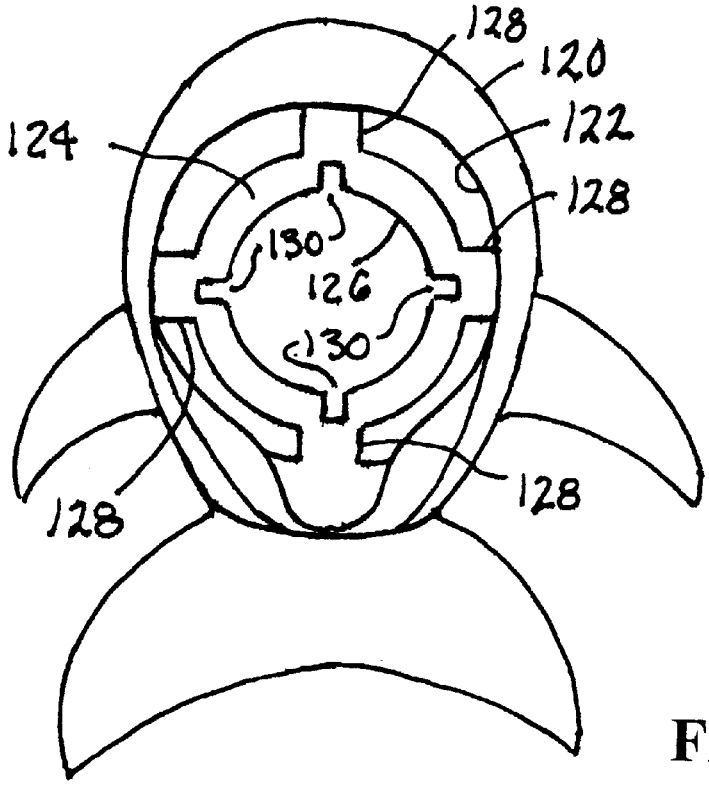
FIG. 24 is a rear view of FIG. 23.
Figure 30:
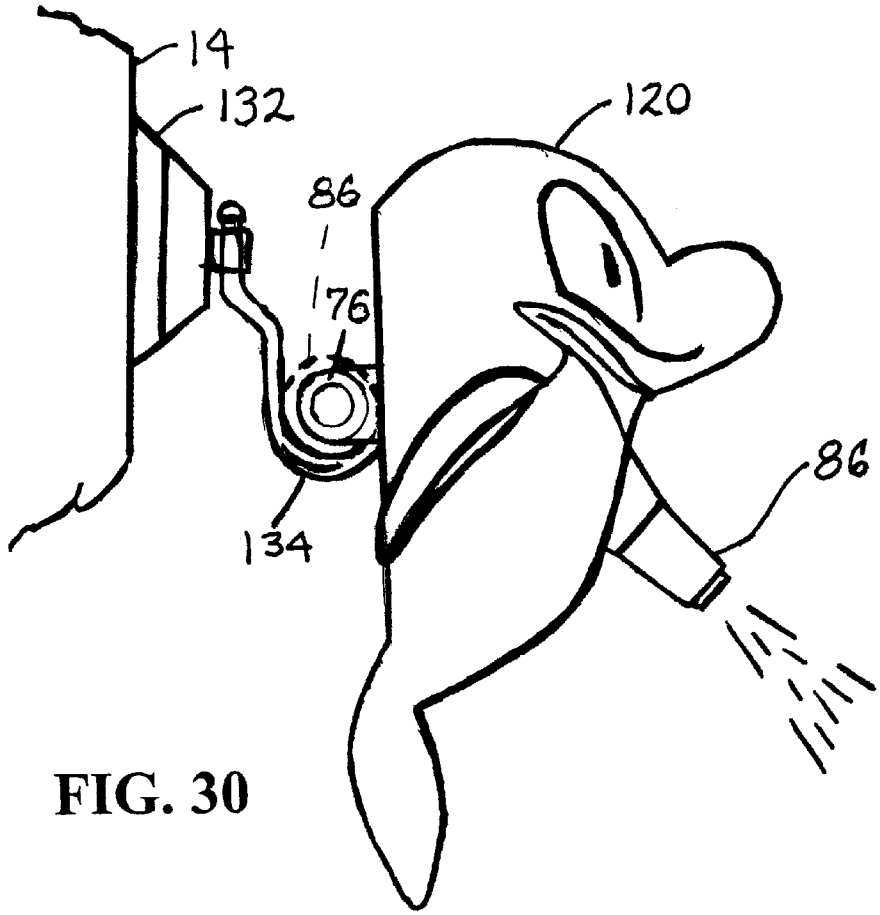
FIG. 30 is an enlarged view in the direction of arrows 30—30 in FIG. 22.

Each outlet 72 further comprises an ornamental figure that is associated with the respective nozzle assembly 86. An example of such a figure is shown in FIGS. 23, 24, and 30. The example is an animal character 120, such as a marine animal. The particular character shown is an artistic three-dimensional rendering of a dolphin. The dolphin is molded from a soft, water impervious material such as soft polyvinyl chloride. Certain features may be added, and/or emphasized, by additional processes such as by painting. As shown by FIG. 24, the body of character 120 comprises an internal cavity 122 that is open toward the rear. A generally cylindrical wall 124 extends frontally within cavity 122 to form an open mouth 126 of the dolphin, as viewed in FIG. 23. Wall 124 integrally joins with the character's body by four ribs 128 that are internal to cavity 122 approximately 90° apart about, and running parallel with, an imaginary centerline of wall 124. A groove 130 that opens radially inward to that centerline runs along the length of each rib.

Each connected tee fitting 74 and nozzle assembly 86 form an assembly onto which the respective character 120 is fit to allow the distal end of outlet part 90 to protrude from the open mouth 126 of the character. The character may be fit to the assembly in various ways. The character may simply. rest on the assembly, such as by hanging on the assembly. Wings 106 may lodge in opposite grooves 130. A suction cup may support the character directly from the tub.

Figure 28:
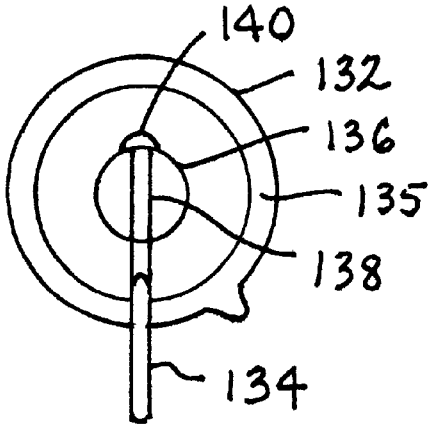
FIG. 28 is a front elevation view of another one of the parts of the embodiment of FIG. 22.
Figure 29:
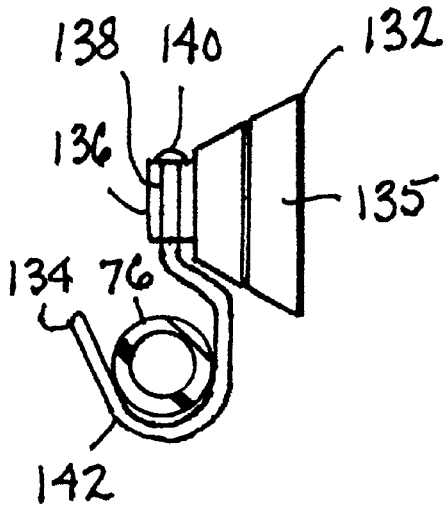
FIG. 29 is a side view of FIG. 28.

Nozzle assembly 86 is like that manufactured by Spraying Systems, Inc., Wheaton, Ill. as model 38720-PPB-X18. FIG. 30 shows an example where character 120 is fit onto an assembly, and the assembly is supported by a suction cup assembly 132 having a hook 134 that is engaged with one of conduits 76 immediately proximate the assembly. FIGS. 28 and 29 show detail of suction cup assembly 132.

In addition to hook 134, suction cup assembly 132 comprises a suction cup 135. The concave face of suction cup 135 adheres by suction force to the tub surface. A circular hub 136 is disposed at the center of the cup on the cup face that is opposite the adhered concave face. Hook 134 comprises a straight shank 138 that extends through a diametrical hole in hub 136. An end of the shank that exits one end of the hub hole has a head 140. The opposite end of the shank merges into a generally U-shaped hook portion 142. When suction cup 135 is adhered to the tub with hook 134 substantially vertical as shown, hook portion 142 provides an upwardly open throat into which conduit 76 may be placed, as shown, so that the hook cradles the conduit. Head 140 prevents the downward force from pulling the hook out of the hub, and the straight shank allows the hook to turn within the hub. A sufficient number of suction cups assemblies are employed to provide adequate support for the accessory.

Instead of cradling a conduit 76, a suction cup hook 134 may cradle a tee fitting or may hook directly onto a character 120.

When the faucet is opened, water under pressure is conveyed to each outlet 72 where the water is emitted as a stream, or spray, from the corresponding nozzle assembly 86.

The visual effect is that the stream or spray appears to be emanating from the open mouth 126 of each dolphin. It is believed that the appearance of the ornamental characters 120 spewing fresh water out of their mouths can encourage young children to bathe in a bath tub, an activity that some young children may otherwise resist.

The illustrated construction and arrangement offers two further possibilities that may increase bathing pleasure. One, each nozzle assembly 86 is adjustable to adjust the nature of the stream or spray that it emits; two, each nozzle assembly may be aimed in a particular direction. FIG. 30 shows nozzle assembly 86 aimed downward at about a 30° inclination to the horizontal. If nut 84 is loosened sufficiently to allow inlet part 88 to turn about the centerline of screw thread 80, turning of the nozzle assembly on the end of the tee fitting will cause the centerline of the nozzle assembly to describe a 30° cone. If wall 124 does not present an interference to the turning of the nozzle assembly, the latter may be aimed in any direction about the cone. For example, if the nozzle assembly were turned 180° from the position of FIG. 30, it would be aimed upward at 30° to the horizontal. After the nozzle assembly has been aimed, the nut is retightened.

Turning outlet part 90 on inlet part 88 adjusts the spray or stream of water emitted through hole 112. FIG. 27 shows the construction of the distal end of inlet part 88. Although that distal end is imperforate to the interior of the part, its exterior comprises a perimeter ridge surrounding a cylindrical void 148. The raised perimeter ridge consists of two segments 150, 152 in opposite halves. The two halves are separated by slots 154, 156 that are generally tangential to opposite ends of a diameter across void 148. The outside diameter of part 88 where cross-bore 98 is located provides radial clearance to the surrounding inside diameter of outlet part 90 when the two parts 88, 90 are threaded together to form nozzle assembly 86. Water that passes through inlet part 88 can therefore exit at the ends of cross-bore 98 to enter the space provided by that clearance. Seal 100 prevents escape of the water from the proximal end of that space, forcing the water to flow toward the distal end of part 88. If part. 90 is fully tightened on part 88, water is constrained to flow to void 148 through slots 154, 156 because ridge segments 150, 152 are abutting, or substantially abutting, the end wall of part 90 that has hole 112 at its center. But because void 148 is centered to hole 112, the water entering void 148 is then emitted through hole 112. This restrictive effect causes the water to be emitted as a spray-like mist in the shape of a cone.

If part 90 is not fully tightened on part 88, seal 110 still functions in the same way, but ridge segments are now spaced some from the end wall of part 90 that contains hole 112, decreasing the restrictive effect. The conical spray can be continually adjusted until the water is ultimately emitted as a stream, rather than conical spray.

Figure 31:
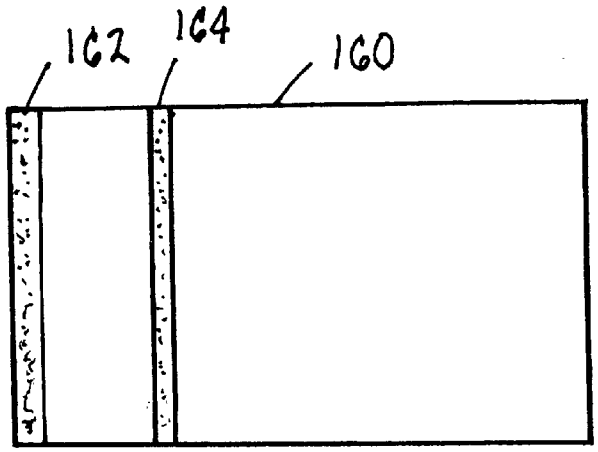
FIG. 31 is a plan view of an accessory that can be used with the disclosed embodiments.
Figure 32:
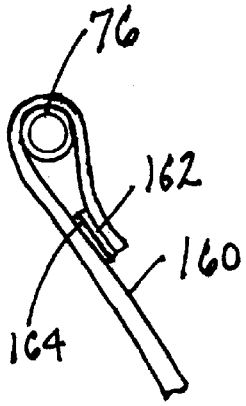
FIG. 32 is a side elevation view of the accessory of FIG. 31 in use with the embodiment of FIG. 22.

If desired a back rest pad 160 of soft, water resistant material, shown in FIG. 31, may be assembled onto the conduit 76 that runs across the back of the tub between opposite sides of the tub. The backings of complementary Velcro® strips 162, 164 are adhered to one face of the pad mutually parallel, as shown. Strip 162 may be loop-type material, and strip 164, hook-type. That end of the pad is looped around the conduit, as shown by FIG. 32, to adhere the two strips together, thereby suspending the pad from the conduit.

Figure 33:
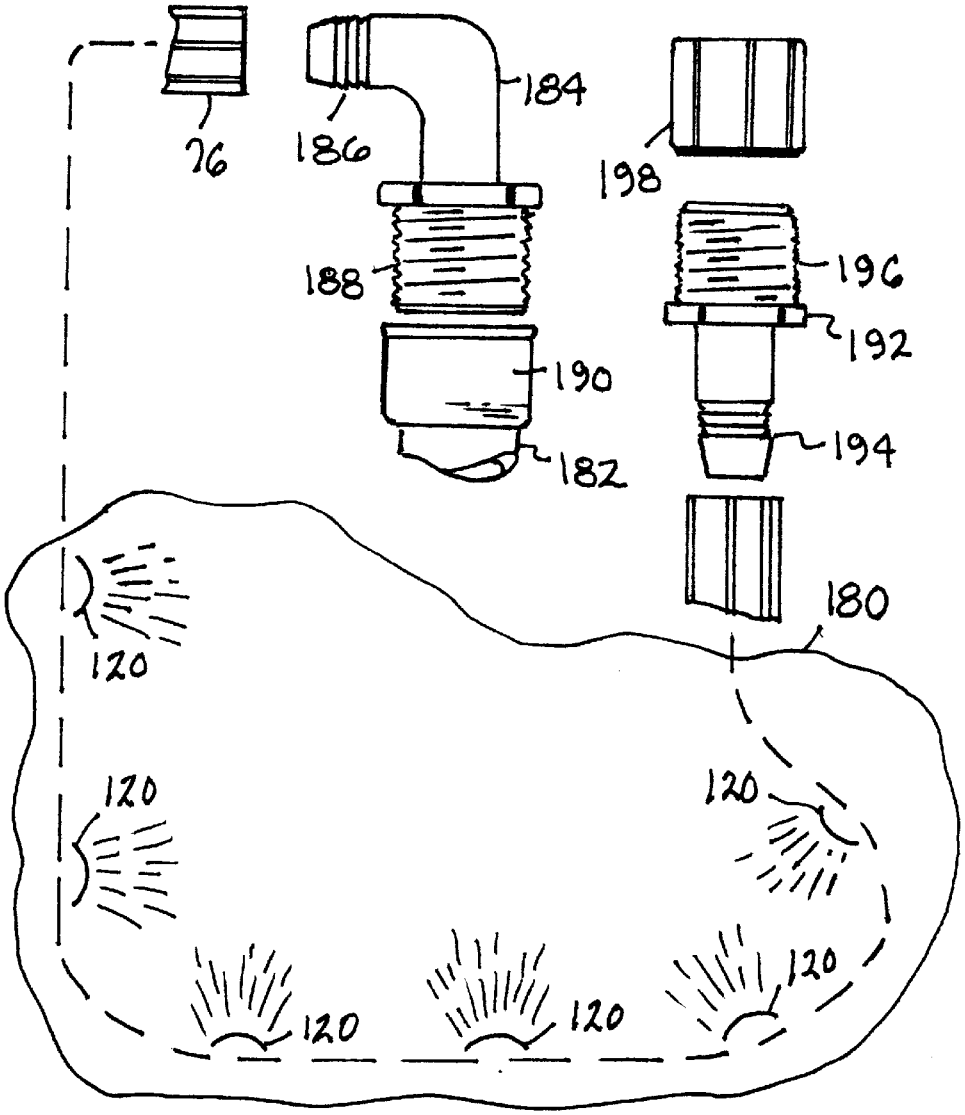
FIG. 33 is a view showing an embodiment of the invention in use on a lawn.

The device may be used in an open area, not necessarily having a tub, by supporting the characters and/or fitting and/or conduits in any suitable manner. FIG. 33 shows an embodiment laid out on a lawn 180 where ground stakes, not shown, may be used to support the characters 120 and nozzle assemblies 86 so that the nozzle assemblies can be aimed at an upward inclination to direct water jets at individuals within the surrounded area of the lawn. A lawn hose 182 may be used to deliver water. The configuration shown is not a closed loop. One end is connected to hose 182 by a fitting 184 having a barbed connector 186 at one end and a threaded connector 188 at the other. Connector 186 is pressed into the end of a conduit 76 and connector 188 is screwed into a mating connector 190 on the hose end.

Figure 34:
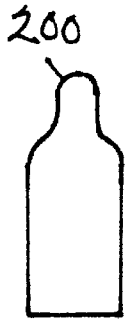
FIG. 34 is a view showing an element that can be used in substitution of other elements of the embodiment of FIG. 33.

The conduit 76 at the far end must be closed when the loop is open. Another connector 192 having a barbed end 194 and a threaded end 196 is fit to that conduit, and a closure cap 198 is screwed tight onto end 196. An alternate closure 200 is shown in FIG. 34. It is a vinyl closure sleeve that can fit directly over and onto the end of the conduit. All fittings are preferably polymeric material such as nylon or polypropylene. The conduits are also polymeric or rubber. The hooks of the suction cups are also preferably non-metallic.

Figure 35:
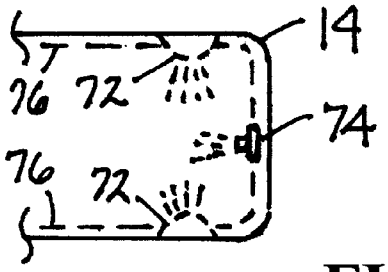
FIG. 35 is a modified form of a portion of FIG. 22.

FIG. 35 is like FIG. 22 except that a tee fitting 74 is inserted into the conduit that runs along the back of the tub. In homes where water pressure is relatively high, that tee fitting serves as a bleed that allows the outlets 72 to perform in the intended manner described above. This is seen to be a desirable alternative to increasing the diameter of the conduit.

In certain homes, it may be desirable to include a back-flow preventer, or check valve, at tee 70 to prevent water that has passed through the tee from creating a back pressure that could blow off the connector that attaches to the faucet.

Rather than having an external screw thread at the outlet of a tee fitting, an internal screw thread may be provided. Other parts are modified appropriately to connect to the internal screw thread. It is believed that this can enhance commonality of parts, and also allow the back-flow preventer to efficiently integrate with a tee fitting.

The various parts that have been described can be fabricated in various colors to present a pleasing appearance, especially to children. Various characters can also be used to interest young children.

While a presently preferred embodiment has been illustrated and described, it is to be appreciated that the invention may be practiced in various forms within the scope of the following claims.

What is claimed is:

1. An accessory for a bathtub comprising:

a tubular non-metallic conduit that is adapted to be placed around the side of a bathtub and adapted to be connected to a bathtub faucet to provide for water from the faucet to flow through the conduit;

the conduit comprising outlets at locations along its length through which the water leaves the conduit and is directed into the bathtub, non-metallic elements adapted to support the conduit on the bathtub at locations along the length of the conduit, in which the non-metallic elements comprise suction cups for adhering to a surface of the bathtub, and connections from each suction cup to the conduit, in which each connection comprises a hook.

2. An accessory for a bathtub as set forth in claim 1 including a respective strap that supports the conduit from the respective hook.

3. An accessory for a bathtub as set forth in claim 1 including a soft cover cladding the conduit.

4. An accessory for a bathtub as set forth in claim 3 in which the cover comprises holes corresponding to the outlets in the conduit.

5. An accessory for a bathtub as set forth in claim 4 including nozzles at the outlets protruding through the holes in the cover.

6. An accessory for a bathtub as set forth in claim 1 including nozzles at the outlets.

7. An accessory for a bathtub as set forth in claim 1 in which the conduit forms an endless loop around the tub and is connectable to the faucet by a tee fitting.

8. An accessory for a bathtub as set forth in claim 1 in which the conduit is connectable to the faucet by a tee fitting that includes a diverter valve that, when operated to a first position, allows water from the faucet to pass directly through into the tub without entering the conduit, and when operated to a second position, allows water to flow through the conduit.

9. An accessory for a bathtub comprising:

a tubular non-metallic conduit that is adapted to be placed around the side of a bathtub and adapted to be connected to a bathtub faucet to provide for water from the faucet to flow through the conduit;

the conduit comprising outlets at locations along its length through which the water leaves the conduit and is directed into the bathtub, including a pad that forms a backrest for a person seated in the bathtub and that is suspended from the conduit.

10. An accessory for directing water toward a bathtub, the bathtub having a faucet and an interior bath water-facing surface, the accessory comprising:

a tubular non-metallic conduit that is adapted to be removably attached to and extend around the bathtub interior bath water-facing surface and adapted to be connected to the faucet to provide for water from the faucet to flow through the conduit;

the conduit comprising outlets at locations along its length through which the water leaves the conduit and is directed toward the bathing area, each outlet comprising a tee fitting that has an outlet branch through which water is emitted toward the bathing area, and a three-dimensional character that fits over the tee fitting and has an aperture at which the tee fitting branch is disposed.

11. An accessory as set forth in claim 10 in which each outlet further comprises a nozzle attached to the outlet branch of the tee fitting.

12. An accessory as set forth in claim 11 in which each nozzle comprises a first part that is adjustable on a second part to adjust the emitted water from a conical spray to a stream.

13. An accessory as set forth in claim 11 in which each tee fitting comprises barbed ends onto which sections of the conduit fit to connect the outlets in succession along the length of the accessory.

14. An accessory as set forth in claim 11 in which the character represents an aquatic animal, the aperture of the character forms the mouth of the aquatic animal, and the nozzle protrudes from the mouth of the character.

15. An accessory as set forth in claim 10 including the bathtub and further including non-metallic elements supporting the conduit on the tub to dispose the outlets at locations along the sides of the tub, the non-metallic elements comprising suction cups for adhering to a surface of the tub, and connections from each suction cup to the conduit, in which each connection comprises a hook.

* * * * *